US006435092B1

(12) United States Patent
Hillebrand

(10) Patent No.: US 6,435,092 B1
(45) Date of Patent: Aug. 20, 2002

(54) METHOD OF PRODUCING A NEWSPAPER

(75) Inventor: Bernd Anton Hillebrand, Bergrheinfeld (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/581,164

(22) PCT Filed: Dec. 16, 1998

(86) PCT No.: PCT/DE98/03698

§ 371 (c)(1),
(2), (4) Date: Jun. 13, 2000

(87) PCT Pub. No.: WO99/30909

PCT Pub. Date: Jun. 24, 1999

(30) Foreign Application Priority Data

Dec. 16, 1997 (DE) ..... 197 55 692

(51) Int. Cl.[7] ..... B41F 1/54; B41F 13/56

(52) U.S. Cl. ..... 101/483; 270/21.1; 270/32; 283/56; 283/67; 281/15.1

(58) Field of Search ..... 101/483, 227; 283/56, 36, 67; 270/21.1, 41, 32, 7; 493/342; 281/15.1

(56) References Cited

U.S. PATENT DOCUMENTS

| | | | | | |
|---|---|---|---|---|---|
| 3,807,771 | A | * | 4/1974 | Greason | 283/56 |
| 3,819,172 | A | * | 6/1974 | Santa Ella | 270/41 |
| 3,930,700 | A | | 1/1976 | Figueres | |
| 3,995,555 | A | * | 12/1976 | Stewart | 101/227 |
| 4,011,985 | A | * | 3/1977 | Simons | 283/56 |
| 4,195,864 | A | * | 4/1980 | Morton et al. | 283/56 |
| 4,279,409 | A | * | 7/1981 | Pemberton | 270/32 |
| 4,305,605 | A | * | 12/1981 | Vine | 283/56 |
| 4,538,517 | A | * | 9/1985 | Michalik | 101/227 |
| 4,685,699 | A | * | 8/1987 | Hirasawa | 283/51 |
| 4,754,959 | A | * | 7/1988 | Kobler et al. | 270/21.1 |
| 4,799,413 | A | * | 1/1989 | Söderqvst | 83/73 |
| 4,842,303 | A | * | 6/1989 | Molenda | 281/2 |
| 5,004,270 | A | * | 4/1991 | Schaal et al. | 283/56 |
| 5,087,805 | A | * | 2/1992 | Silvershotz | 219/121.71 |
| 5,193,851 | A | * | 3/1993 | Honegger | 281/15.1 |
| 5,230,501 | A | * | 7/1993 | Melton | 270/41 |
| 5,340,017 | A | * | 8/1994 | Tighe | 229/300 |
| 5,367,934 | A | * | 11/1994 | MacNiel | 83/425.2 |
| 5,487,566 | A | * | 1/1996 | Hedge, Jr. | 283/56 |
| 5,531,530 | A | * | 7/1996 | Kuramoto et al. | 400/621 |
| 5,713,606 | A | * | 2/1998 | Kleinberg et al. | 281/42 |
| 5,749,567 | A | * | 5/1998 | DeAngelis | 270/7 |
| 5,823,934 | A | * | 10/1998 | Ferrone | 493/342 |
| 5,868,498 | A | * | 2/1999 | Martin | 283/11 |
| 5,871,828 | A | * | 2/1999 | Volkert | 428/40.1 |
| 5,911,442 | A | * | 6/1999 | Olson | 283/36 |
| 6,039,356 | A | * | 3/2000 | Warther et al. | 283/61 |
| 6,068,903 | A | * | 5/2000 | Volkert | 428/40.1 |
| 6,129,346 | A | * | 10/2000 | Zora | 270/52.19 |
| 6,268,032 | B1 | * | 7/2001 | Mertens et al. | 428/40.1 |

FOREIGN PATENT DOCUMENTS

| | | | |
|---|---|---|---|
| DE | 23 41 326 | | 7/1977 |
| DE | 87 02 826 | | 5/1987 |
| DE | 93 15 431 | | 12/1993 |
| JP | 08262977 | A * | 10/1996 |

OTHER PUBLICATIONS

Walenski, Von Wolfgang, Perforieren Sie als Offsetdrucker etwa immer noch im Buchdruck?, pps. 45–46, Polygraph Treffpunkt Druckindustrie, 9/96.

Gross Community, Jul. 1, 1977.

* cited by examiner

*Primary Examiner*—Eugene Eickholt
(74) *Attorney, Agent, or Firm*—Jones, Tullar & Cooper, PC

(57) ABSTRACT

A method for producing a printed product, such as a newspaper using a plurality of product and part-product webs. The webs, or selected ones of the webs can be longitudinally or transversely perforated or both. This allows a simple way for accomplishing the removal of parts of the printed product, such as selected advertisements or selected columns of material.

15 Claims, 4 Drawing Sheets

"Z"

METHOD OF PRODUCING A NEWSPAPER

FIELD OF THE INVENTION

The present invention relates to a method for producing a newspaper. A plurality of webs or partial webs are used to produce the newspaper. Portions of the webs are perforated.

DESCRIPTION OF THE PRIOR ART

DE 87 02 826 U1 shows a page of a newspaper with information fields surrounded by perforations.

U.S. Pat. No. 4,685,699 a describes a page provided with perforations for insertion into a newspaper.

A publication with removable cards is known from U.S. Pat. No. 3,930,700 A.

SUMMARY OF THE INVENTION

The object of the present invention is based on creating a printed product.

The following advantages in particular are achieved by means of the invention:

In connection with a newspaper that is product or newspaper-like product, such as a newspaper that is distributed free of charge, and which has private small advertisements, for example, it is possible to remove entire pages or partial sections of pages, in a very simple manner from the total product. For example, individual columns with defined contents, for example stock prices, tables with the results of soccer games, TV programs, or small ads in defined columns, for example the headings "toys" or "BMW", can be removed from the total product.

In prior newspapers which have typically been distributed free of charge, private ads of more or less small sizes, for example, and small commercial ads, are printed under a large number of different predefined headings. The customers for these printed products as a rule buy these products for obtaining entire predefined groups of information. For example, a customer will select the headings "toys" or "BMW" in order to find the private party who has such items for sale. As a rule, difficulties presently arise in connection with "removing" the desired groups of information quickly and in a practical manner from the cumbersome total product, which otherwise is no longer of interest. Either the entire page or partial sections of the product are torn out or cut out, marked in writing, or the most important information, for example the telephone number, is noted on a piece of paper.

The present invention proposes to frame, or to define, the respective blocks of information, such as portions of the newspaper or newspaper-like product which are connected by their content, by means of a perforation line in such a way that these blocks of information or portions of the newspaper can be easily removed from the entire product without additional aids, such as scissors, for example. This possibility is aided by the design of the information in these products, which as a rule is in columns.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
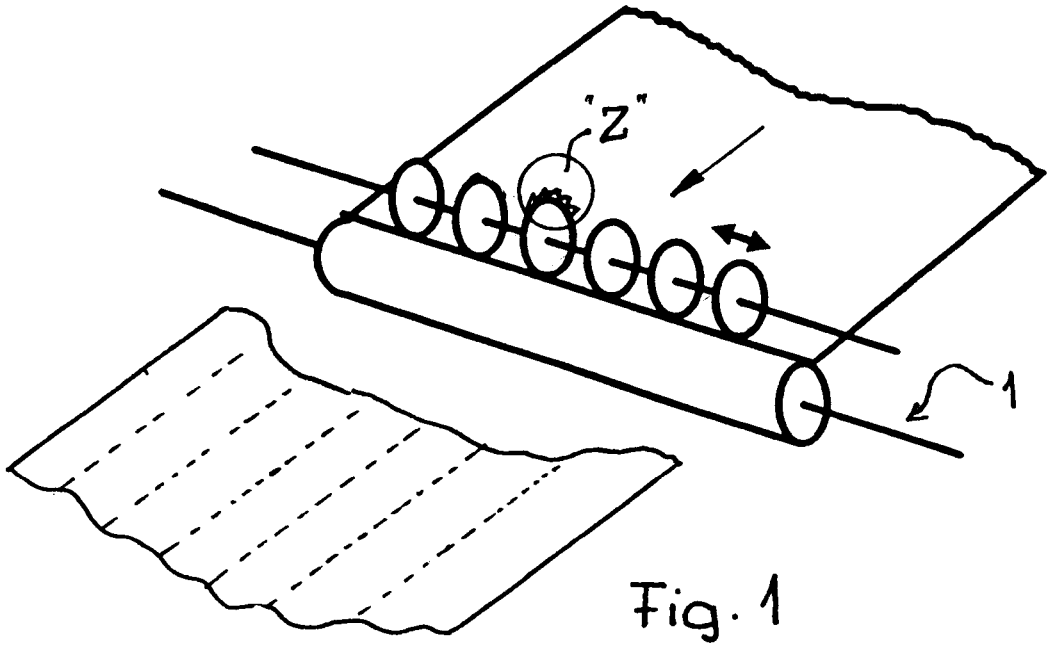
FIG. 1, a schematic representation of a longitudinal perforation device.
Figure 3:
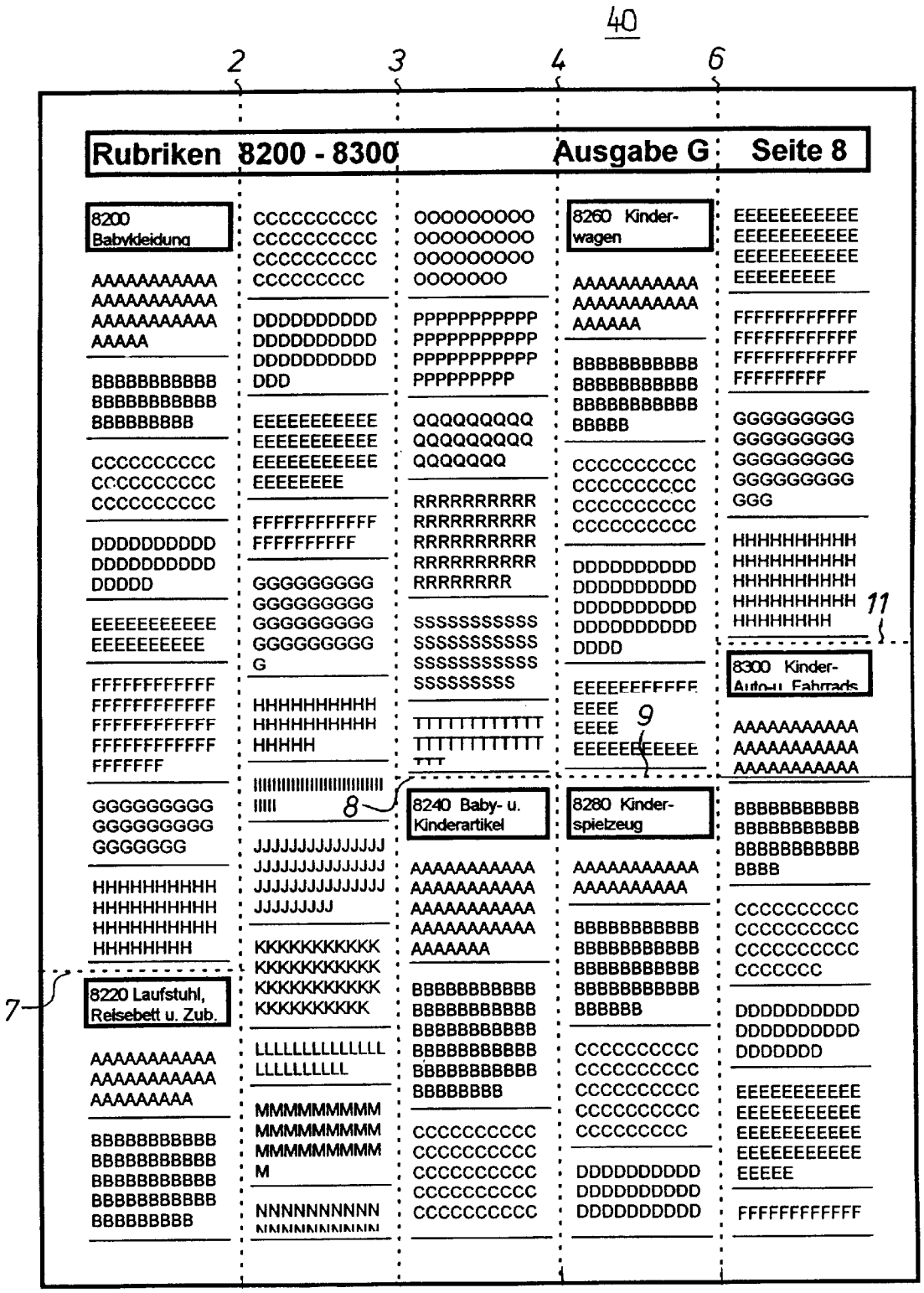
FIG. 3, a schematic representation of a newspaper page.

In connection with the present printed product, it is possible to selectively surround a block of information of the same type, for example an advertisement, a group of advertisements, a group of advertisements in the form of a column, and entire column, or portions of columns, with longitudinal perforations 2, 3, 4, 6 and/or with transverse perforations 7, 8, 9, 11, and to separate these selected blocks of information in this way from the remainder of the printed product all as seen in FIGS. 1 and 3.

The principle of the present invention is represented in what follows by the use of the example of a schematically represented newspaper, which is distributed free of charge. It is important here that the perforations are matched to the extent possible to the blocks of information on the front and the back.

Figure 2:
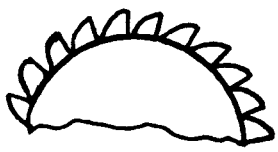
FIG. 2, a detail from FIG. 1.

The multifunctional perforation can be achieved by means of machine technology in the following manner:

Assuming that the newspaper product is designed in the form of a broadsheet product in columns, and that all pages are produced with the same column width, the longitudinal perforation device generally at 1 as seen in FIG. 1 can be arranged at a location at which several, or even all, webs or strands of webs are combined. Because of this, one longitudinal perforation device 1 with several perforation cutters such as cutters Z, as seen in FIGS. 1 and 2 which can be of variable width transversely to the paper web, is sufficient.

If, however, individual pages are to be differently longitudinally perforated, these pages, or respectively the associated paper web, must be equipped with a separate longitudinal perforation device.

The transverse displacement of the individual longitudinal perforation cutters can be performed manually or in an automated manner, and in the extreme case can be performed by remote control.

In the simplest case, transverse perforations such as one of the transverse perforations 7, 8, 9 and 11 shown in FIG. 3 can be uniform for all pages of the product. In this case, only one transverse perforation device is required. If all pages only have a single transverse perforation, one transverse perforation cutter is sufficient.

If several transverse perforations are required, the transverse perforation device must be equipped with several transverse perforation cutters. Ideally, the transverse perforation cutters are arranged in such a way that they can be varied in number, as well as in their circumferential position, and therefore also in the distances between the perforation lines.

In the extreme case, each page has several transverse perforation lines which are different from page to page, and which can extend over the entire page width or over a partial width of the page, for example a longitudinally perforated column. In this case, it is necessary that each paper web be equipped with a transverse perforation device, which contains one transverse perforation cutter for each of the required number of transverse perforations over the width of the paper web, and for the required number of transverse perforations, over a length of the paper web corresponding to a cylinder circumference or to half a cylinder circumference.

The cutter holder must be designed such that the respective cutter positions can be varied in the transverse and in the circumferential directions, that different perforation cutters of different widths can be used, and that the number of cutters and their circumferential positions in respect to each other can be varied.

In this case, the use of an electronically controlled independent drive mechanism for this perforation device makes the synchronization of perforation and rotation and of an exactly register-maintaining perforation easier.

If the product is made as a tabloid, the "column perforation" is created by utilization of the transverse perforation device. The perforation which is horizontal in the reading direction in the tabloid type end product, however, is produced by means of a longitudinal perforation device. If the product is not only to be perforated continuously horizontally, but also is to be perforated partially, for example in columns, the perforating circumference of the longitudinal perforation cutter Z is divided in accordance with the column width, similar to a skip-slitter cutter.

In order to be able to react as flexibly as possible to different column widths and to columns, which are to be perforated, or respectively not perforated, within the same perforation track, it is necessary that the longitudinal perforation cutter holder of the longitudinal perforation device 1 can be universally employed. To this end it is necessary that it can be displaced transversely to the web running direction as desired, and can receive different perforation cutters of different circumferential design or, even better, different individual cutter circumference segments at any arbitrary location. Because of this, it is possible to create perforation lines of any desired width, which can be interrupted at any desired intervals, and at any desired location of the page.

Figure 4:
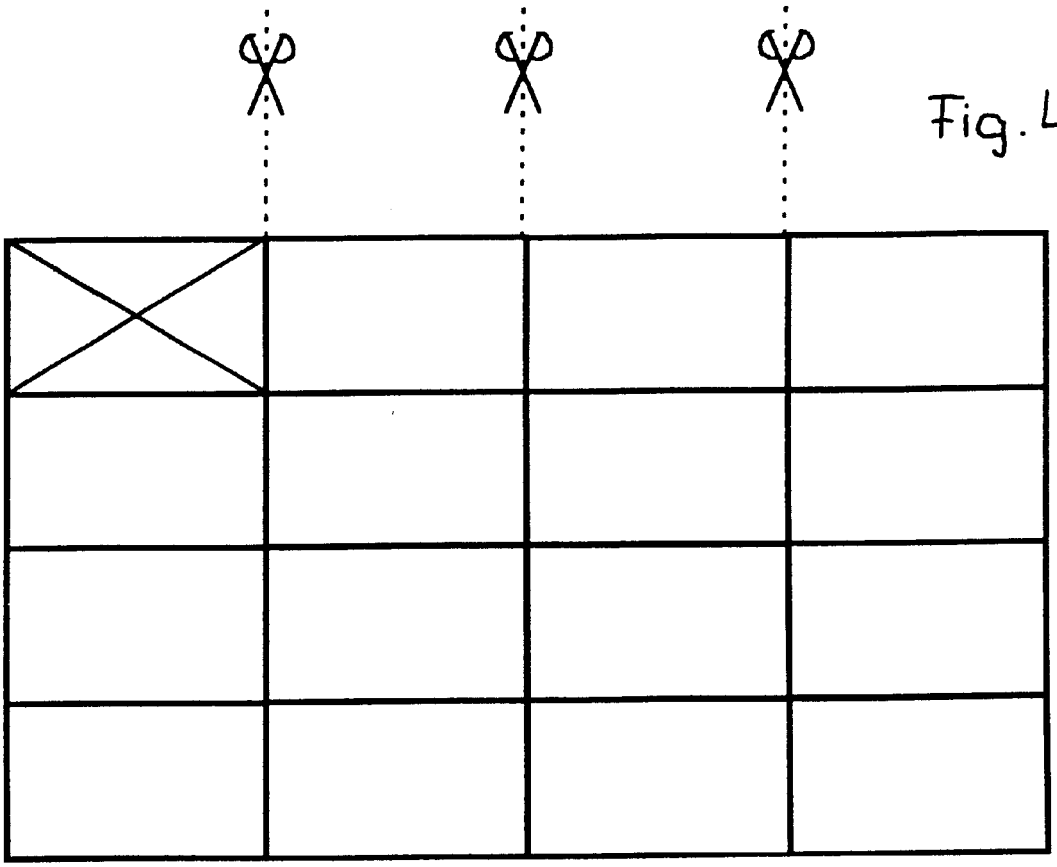
FIG. 4, a schematic representation of a material web which is four broadsheet pages wide, and in FIG. 5, a schematic representation of a material web of variable width.
Figure 5:
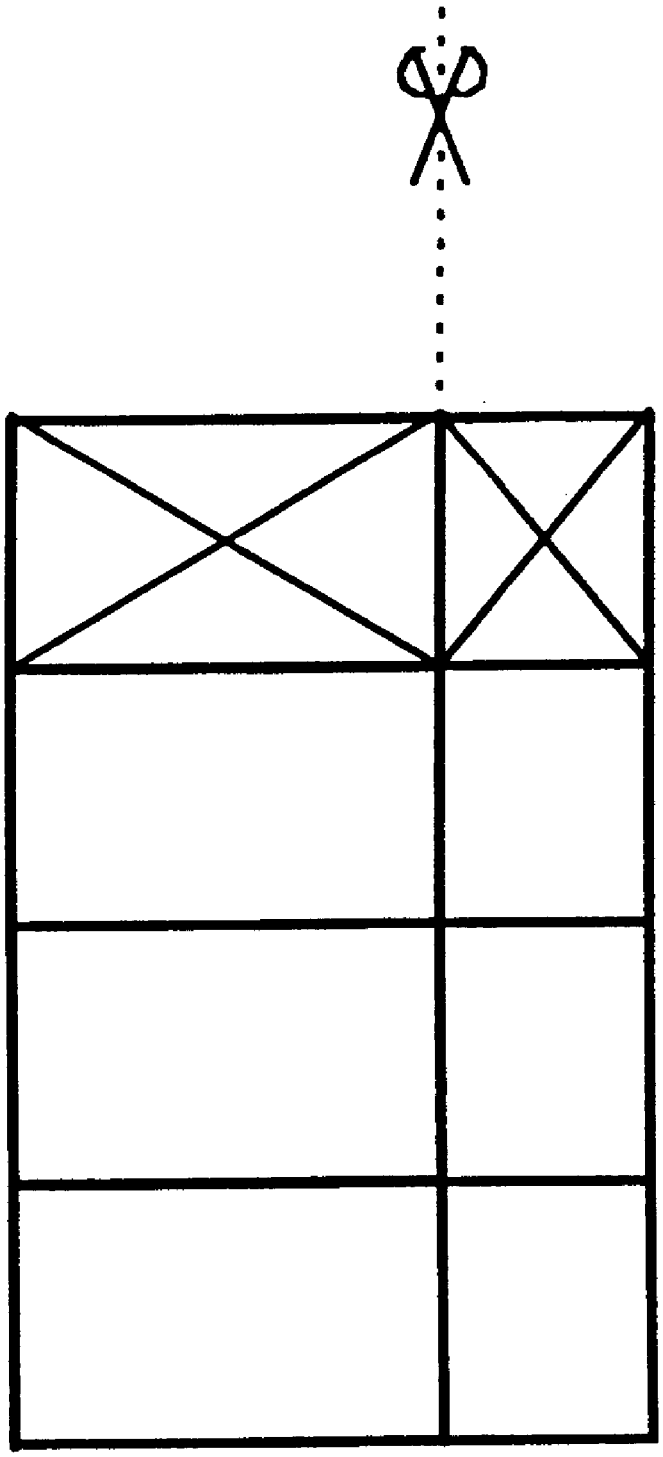

In this connection, it has been shown to be technically advantageous to operate with variable web widths between one half and a full web width in case of single-width rotations, and in case of double-width rotations with variable web widths between a quarter and half a web width. The reason for this is that very narrow web widths such as web widths narrower than a broadsheet page are very difficult to handle by current machine technology, and that too large a number of different web widths is uneconomical to procure. For example, in a double-width rotation it is possible to achieve the same effect with a ⅜-width and a normally present ½-width web as with a ⅞-width web as depicted in FIGS. 4 and 5.

The additional web strip of arbitrary width can be employed for all products which can be produced in the newspaper rotation, such as broadsheet products, tabloid products, magazine products, etc., for example, and can be processed with web guide elements customary in-newspaper rotation, such as turning bars, mixing arrangements, funnel groups, etc., and with their help can be placed at almost any location in the product. It is moreover possible to attach these width-variable web strips, which are processed into lateral strips of partial width, to the whole product by means of all known fastening or attachment devices, for example stapling or gluing devices, etc. In the same way it is possible to use and process several webs of variable web width simultaneously.

While preferred embodiments of a method for producing a newspaper in accordance with the present invention have been set forth fully and completely hereinabove, it will be apparent to one of skill in the art that a number of changes, for example in the specific type of printing cylinders used, he particular folding device and the like, can be made without departing from the true spirit and scope of the present invention which is accordingly to be limited only by the following claims.

What is claimed is:

1. A method for producing a newspaper including:

providing a plurality of material webs, each of said plurality of material webs having a constant web width and at least one material web edge;

providing a plurality of partial material webs;

providing at least one of said plurality of partial material webs as a preselectable variable width partial web with at least one variable width partial web edge;

providing at least one block of information on at least one of said plurality of partial material webs;

providing at least one column of information extending over an entire length of a page of said at least one of said plurality of partial material webs;

forming at least one longitudinal perforation bordering said at least one column of information extending over an entire length of a page of said at least one of said plurality of partial materials webs;

forming longitudinal and transverse perforations bordering said at least one block of information on said at least one of said plurality of partial material webs;

folding said at least one of said plurality of partial width paper webs after forming said longitudinal and transverse perforations in said at least one of said plurality of partial width paper webs;

transversely cutting said plurality of partial material webs into signatures after forming said longitudinal and transverse perforations in said at least one of said plurality of said partial width paper webs; and assembling said plurality of material webs and said plurality of partial material webs on top of each other with said at least one variable width partial web edge and said at least one material web edge being parallel.

2. The method of claim 1 further including providing at least one advertisement and bordering said at least one advertisement by perforations.

3. The method of claim 1 further including providing several advertisements and bordering said several advertisements by perforations.

4. The method of claim 1 further including providing several advertisements and bordering each of said advertisements individually by perforations.

5. The method of claim 1 further including providing said at least one column including advertisements.

6. The method of claim 1 further including providing said perforations as said longitudinal and transverse perforations in said plurality of partial material webs.

7. The method of claim 1 further including providing a plurality of said transverse and longitudinal perforations which are differently spaced apart.

8. The method of claim 1 further including producing said newspaper on a web-fed rotary printing press.

9. The method of claim 1 further including transversely cutting said preselectable variable width partial web and inserting said transversely cut preselectable variable width partial web between said material webs and said plurality of said partial material webs.

10. The method of claim 1 further including transversely cutting said preselectable variable width partial web and attaching said transversely cut preselectable variable width partial web to said material webs and said plurality of said partial material webs.

11. The method of claim 1 further including providing said newspaper as one of a broadsheet, tabloid and magazine product.

12. The method of claim 8 further including producing said newspaper on quarter page, eight page and sixteen page newspaper web-fed rotary printing presses.

13. The method of claim 1 further including providing said perforations extending obliquely to a material web transport direction.

14. The method of claim 1 further including providing a longitudinal perforating device and assigning several of said plurality of partial material webs to said longitudinal perforating device for forming said perforations.

15. The method of claim 1 further including providing one longitudinal perforating device and assigning all of said plurality of partial material webs to said one longitudinal perforating device for forming said perforations.

* * * * *